US008234830B2

(12) United States Patent
Pervan et al.

(10) Patent No.: US 8,234,830 B2
(45) Date of Patent: Aug. 7, 2012

(54) MECHANICAL LOCKING SYSTEM FOR FLOOR PANELS

(75) Inventors: Darko Pervan, Viken (SE); Agne Pálsson, Hasslarp (SE)

(73) Assignee: Välinge Innovations AB, Viken (SE)

( * ) Notice: Subject to any disclaimer, the term of this patent is extended or adjusted under 35 U.S.C. 154(b) by 0 days.

(21) Appl. No.: 13/020,456

(22) Filed: Feb. 3, 2011

(65) Prior Publication Data

US 2011/0225922 A1 Sep. 22, 2011

Related U.S. Application Data

(60) Provisional application No. 61/301,402, filed on Feb. 4, 2010.

(51) Int. Cl.
*E04B 2/00* (2006.01)

(52) U.S. Cl. ..... 52/588.1; 52/582.1; 52/587.1

(58) Field of Classification Search ..... 52/588.1, 52/582.1, 582.2, 587.1, 586.1, 586.2, 585.1, 52/390, 392, 533, 534, 539, 553, 578, 581.1, 52/589.1, 590.2, 590.3, 591.1, 591.2, 591.3, 52/591.4, 591.5, 592.1, 582.4, 745.08, 745.19, 52/747.1, 747.11, 748.1, 748.11; 403/334, 403/345, 364–368, 372, 375, 376, 381; 428/44, 428/47–50, 57–58, 60, 61, 106, 192–194
See application file for complete search history.

(56) References Cited

U.S. PATENT DOCUMENTS

| | | | |
|---|---|---|---|
| 124,228 | A | 3/1872 | Stuart |
| 1,809,393 | A | 6/1931 | Rockwell |
| 1,902,716 | A | 3/1933 | Newton |
| 2,026,511 | A | 5/1934 | Storm |
| 2,204,675 | A | 6/1940 | Grunert |
| 2,732,706 | A | 1/1956 | Friedman |
| 2,740,167 | A | 4/1956 | Rowley |
| 2,863,185 | A | 12/1958 | Riedi |
| 2,865,058 | A | 12/1958 | Andersson et al. |
| 3,023,681 | A | 3/1962 | Worson |
| 3,271,787 | A | 9/1966 | Clary |
| 3,378,958 | A | 4/1968 | Parks et al. |
| 3,396,640 | A | 8/1968 | Fujihara |
| 3,512,324 | A | 5/1970 | Reed |
| 3,526,071 | A | 9/1970 | Watanabe |
| 3,535,844 | A | 10/1970 | Glaros |
| 3,572,224 | A | 3/1971 | Perry |
| 3,579,941 | A | 5/1971 | Tibbals |
| 3,720,027 | A | 3/1973 | Christensen |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |

(Continued)

FOREIGN PATENT DOCUMENTS

DE 199 40 837 A1 11/2000

(Continued)

OTHER PUBLICATIONS

U.S. Appl. No. 13/232,467, Pervan et al.

(Continued)

*Primary Examiner* — Mark Wendell
(74) *Attorney, Agent, or Firm* — Buchanan Ingersoll & Rooney PC

(57) ABSTRACT

Floor panels (1*b*, 1*c*) are shown which are provided with a mechanical locking system comprising a tongue with rocker arms that allows locking by a vertical turning motion.

24 Claims, 4 Drawing Sheets

U.S. PATENT DOCUMENTS 3,849,235 A 11/1974 Gwynne
3,919,820 A 11/1975 Green
4,030,852 A 6/1977 Hein
4,064,571 A 12/1977 Phipps
4,080,086 A 3/1978 Watson
4,082,129 A 4/1978 Morelock
4,100,710 A 7/1978 Kowallik
4,107,892 A 8/1978 Bellem
4,113,399 A 9/1978 Hansen, Sr.
4,169,688 A 10/1979 Toshio
4,299,070 A 11/1981 Oltmanns
4,426,820 A 1/1984 Terbrack
5,071,282 A 12/1991 Brown
5,148,850 A 9/1992 Urbanick
5,173,012 A 12/1992 Ortwein et al.
5,182,892 A 2/1993 Chase
5,247,773 A 9/1993 Weir
5,344,700 A 9/1994 McGath et al.
5,348,778 A 9/1994 Knipp et al.
5,465,546 A 11/1995 Buse
5,548,937 A 8/1996 Shimonohara
5,598,682 A 2/1997 Haughian
5,618,602 A 4/1997 Nelson
5,634,309 A 6/1997 Polen
5,694,730 A 12/1997 Del Rincon et al.
5,755,068 A 5/1998 Ormiston
5,899,038 A 5/1999 Stroppiana
5,950,389 A 9/1999 Porter
6,006,486 A 12/1999 Moriau et al.
6,052,960 A 4/2000 Yonemura
6,173,548 B1 1/2001 Hamar et al.
6,314,701 B1 11/2001 Meyerson
6,363,677 B1 4/2002 Chen et al.
6,385,936 B1 5/2002 Schneider
6,418,683 B1 7/2002 Martensson et al.
6,446,413 B1 9/2002 Gruber
6,490,836 B1 12/2002 Moriau et al.
6,505,452 B1 1/2003 Hannig et al.
6,553,724 B1 4/2003 Bigler
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,763,643 B1 7/2004 Martensson
6,804,926 B1 10/2004 Eisermann
6,854,235 B2 2/2005 Martensson
6,862,857 B2 3/2005 Tychsen
6,874,291 B1 4/2005 Weber
6,880,307 B2 4/2005 Schwitte et al.
7,021,019 B2 4/2006 Knauseder
7,040,068 B2 5/2006 Moriau et al.
7,051,486 B2 5/2006 Pervan
7,152,383 B1 12/2006 Wilkinson
7,188,456 B2 3/2007 Knauseder
7,219,392 B2 5/2007 Mullet et al.
7,251,916 B2 8/2007 Konzelmann et al.
7,451,578 B2 11/2008 Hannig
7,454,875 B2 11/2008 Pervan et al.
7,516,588 B2 4/2009 Pervan
7,533,500 B2 5/2009 Morton
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan et al.
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan et al.
7,806,624 B2 10/2010 McLean et al.
7,841,144 B2 11/2010 Pervan
7,841,145 B2 11/2010 Pervan et al.
7,866,110 B2 1/2011 Pervan
7,908,815 B2 3/2011 Pervan et al.
7,980,041 B2 7/2011 Pervan et al.
8,033,074 B2 10/2011 Pervan et al.
8,042,311 B2 10/2011 Pervan et al.
2002/0031646 A1 3/2002 Chen et al.
2002/0170259 A1 11/2002 Ferris
2002/0178674 A1 12/2002 Pervan
2002/0178680 A1 12/2002 Martensson et al.
2003/0009971 A1 1/2003 Palmberg
2003/0024199 A1 2/2003 Pervan et al.
2003/0094230 A1 5/2003 Sjoberg
2003/0101681 A1 6/2003 Tychsen
2003/0180091 A1 9/2003 Stridsman
2003/0188504 A1 10/2003 Eisermann
2003/0196405 A1 10/2003 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0200175 A1 10/2004 Weber
2004/0211143 A1 10/2004 Hanning
2004/0261348 A1 12/2004 Vulin
2005/0160694 A1 7/2005 Pervan
2005/0166514 A1 8/2005 Pervan
2005/0210810 A1 9/2005 Pervan
2006/0101769 A1 5/2006 Pervan et al.
2006/0236642 A1 10/2006 Pervan
2006/0260254 A1 11/2006 Pervan
2007/0006543 A1 1/2007 Engstrom
2007/0028547 A1 2/2007 Grafenauer et al.
2007/0151189 A1 7/2007 Yang
2007/0175156 A1 8/2007 Pervan et al.
2007/0209736 A1 9/2007 Deringor et al.
2008/0000185 A1 1/2008 Duernberger et al.
2008/0010931 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0216920 A1 9/2008 Pervan
2008/0295432 A1 12/2008 Pervan et al.
2009/0100782 A1 4/2009 Groeke et al.
2009/0193748 A1 8/2009 Pervan et al.
2009/0308014 A1 12/2009 Muehlebach
2010/0043333 A1 2/2010 Hannig
2010/0300031 A1 12/2010 Pervan et al.
2010/0319291 A1 12/2010 Pervan et al.
2011/0030303 A1 2/2011 Pervan et al.
2011/0088344 A1 4/2011 Pervan et al.
2011/0088345 A1 4/2011 Pervan
2011/0167750 A1 7/2011 Pervan et al.
2011/0252733 A1 10/2011 Pervan et al.

FOREIGN PATENT DOCUMENTS

DE 199 58 225 A1 6/2001
DE 10 2004 055 951 A1 7/2005
DE 10 2006 024 184 A1 11/2007
DE 10 2006 037 614 B3 12/2007
DE 10 2007 018 309 A1 8/2008
DE 10 2007 035 648 A1 1/2009
EP 0 013 852 A1 8/1980
EP 0 974 713 A1 1/2000
EP 1 420 125 A2 5/2004
EP 1 650 375 A1 4/2006
EP 1 650 375 A8 4/2006
EP 1 650 375 A8 9/2006
FR 1.138.595 6/1957
FR 2 256 807 8/1975
GB 2 051 916 A 1/1981
JP 3-110258 A 5/1991
JP 6-288017 A 10/1994
JP 6-306961 A 11/1994
JP 6-322848 A 11/1994

| | | | |
|---|---|---|---|
| WO | WO 97/47834 | A1 | 12/1997 |
| WO | WO 00/20705 | A1 | 4/2000 |
| WO | WO 00/47841 | A1 | 8/2000 |
| WO | WO 01/02670 | A1 | 1/2001 |
| WO | WO 01/51732 | A1 | 7/2001 |
| WO | WO 01/75247 | A1 | 10/2001 |
| WO | WO 03/016654 | A1 | 2/2003 |
| WO | WO 03/083234 | A1 | 10/2003 |
| WO | WO 03/087497 | A1 | 10/2003 |
| WO | WO 2004/020764 | A1 | 3/2004 |
| WO | WO 2004/079130 | A1 | 9/2004 |
| WO | WO 2004/083557 | A1 | 9/2004 |
| WO | WO 2006/043893 | A1 | 4/2006 |
| WO | WO 2006/050928 | A1 | 5/2006 |
| WO | WO 2006/104436 | A1 | 10/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2008/004960 | | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/004960 | A8 | 8/2008 |
| WO | WO 2010/087752 | A1 | 8/2010 |
| WO | WO 2010/108980 | A1 | 9/2010 |
| WO | WO 01/75247 | A1 | 10/2011 |

OTHER PUBLICATIONS

U.S. Appl. No. 13/253,283, Pervan.

U.S. Appl. No. 13/195,297, Pervan et al.

U.S. Appl. No. 13/146,731, Pervan et al.

Pervan, Darko, et al., U.S. Appl. No. 13/232,467, entitled "Mechanical Locking for Panels and Method of Installing Same," filed in the U.S. Patent and Trademark Office on Sep. 14, 2011.

Pervan, Darko, U.S. Appl. No. 13/253,283, entitled "Mechanical Locking System for Floor Panels," filed in the U.S. Patent and Trademark Office on Oct. 5, 2011.

Pervan, Darko, et al., U.S. Appl. No. 13/195,297, entitled "Mechanical Locking of Floor Panels with a Flexible Bristle Tongue," filed in the U.S. Patent and Trademark Office on Aug. 1, 2011.

Pervan, Darko, et al., U.S. Appl. No. 13/146,731, entitled "Mechanical Lockings of Floor Panels and a Tongue Blank," filed in the U.S. Patent and Trademark Office on Jul. 28, 2011 (371 date is Oct. 13, 2011).

*Complaint, Akzenta Paneele + Profile GmbH and W. Classen GmbH & Co. KG* v. *Brown-West L.L.C d/b/a Carpet One Floor & Home, Shaw Industries Group, Inc. and Valinge Innovation AB*, United States District Court for the Eastern District of Texas, Marshall Division, Case No. 2:10-CV-16, dated Jan. 14, 2010.

*Answer, Affirmative Defenses and Counterclaims of Defendant Välinge Innovation AB, Akzenta Paneele + Profile GmbH and W. Classen GmbH & Co. KG* v. *Brown-West L.L.C d/b/a Carpet One Floor & Home, Shaw Industries Group, Inc. and Valinge Innovation AB*, United States District Court for the Eastern District of Texas, Marshall Division, Case No. 2:10-CV-00016 (TWG)(CE), dated Apr. 9, 2010.

*Plaintiff's First Amended Complaint and Counterclaim on Reply, Akzenta Paneele + Profile GmbH and W. Classen GmbH & Co. KG* v. *Shaw Industries Group, Inc. and Valinge Innovation AB and Darko Pervan*, United States District Court for the Eastern District of Texas, Marshall Division, Case No. 2:10-CV-16, dated Nov. 30, 2010, and attachments thereto.

European prosecution file history, European Patent No. 1863984 (Appln. No. 06700664), dated Oct. 5, 2006 to Sep. 9, 2010.

*Shaw Industries Group, Inc.'s Answer, Defenses and Counterclaims to Plaintiffs' First Amended Complaint and Counterclaim on Reply, Akzenta Paneele + Profile GmbH, Akzenta Vertriebs GmbH and W. Classen GmbH & Co. KG* v. *Shaw Industries Group, Inc. and Välinge Innovation AB and Darko Pervan*, United States District Court for the Eastern District of Texas, Marshall Division, Case No. 2:10-CV-00016 (TJW)(CE), dated Jan. 7, 2011.

*Answer, Affirmative Defenses and Counterclaims of Defendant Välinge Innovation AB to Plaintiffs' First Amended Complaint and Counterclaim on Reply, Akzenta Paneele + Profile GmbH, Akzenta Vertriebs GmbH and W. Classen GmbH & Co. KG* v. *Shaw Industries Group, Inc. and Välinge Innovation AB and Darko Pervan*, United States District Court for the Eastern District of Texas, Marshall Division, Case No. 2:10-CV-00016 (TJW)(CE), dated Jan. 7, 2011.

Laminate Flooring Tips (http://flooring.lifetips.com/cat/61734/laminate-flooring-tips/index.html), 12 pages Copyright 2000.

Engstrand, Ola, Välinge Innovation AB. va043 5G Linear Slide Tongue, IRN-ISSN 1533-0001 IP.com number: I PCOM000179015D Retrieved from: Epoquenet; Database XPIPCOM, Accession No. AN. XP013129255, Feb. 4, 2009.

Pervan, Darko, et al., U.S. Appl. No. 13/329,019 entitled "Mechanical Locking of Panels," filed in the U.S. Patent and Trademark Office on Dec. 16, 2011.

Pervan, Darko, et al., U.S. Appl. No. 13/426,115 entitled "Mechanical Locking System for Floor Panels," filed in the U. S. Patent and Trademark Office on Mar. 21, 2012.

KNOWN ART

Fig. 6a
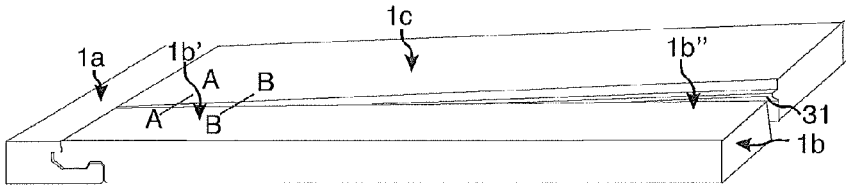
Fig. 6b
Fig. 6c
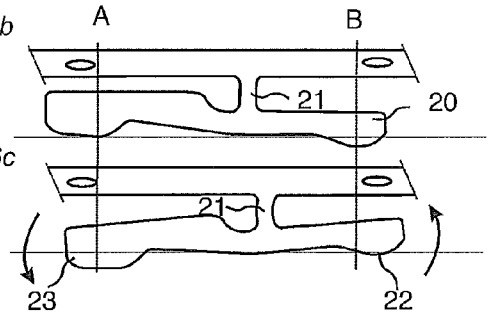
Fig. 6d
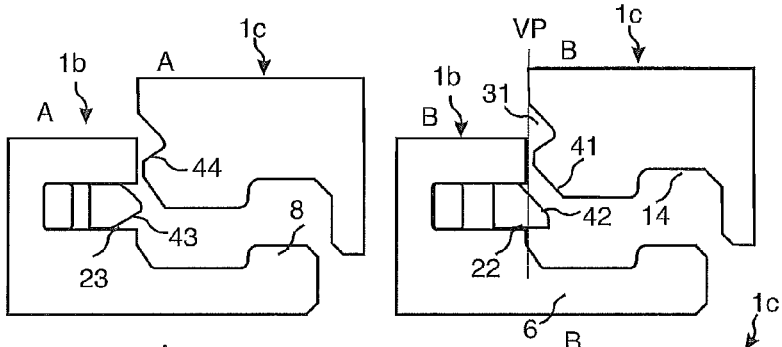
Fig. 6e
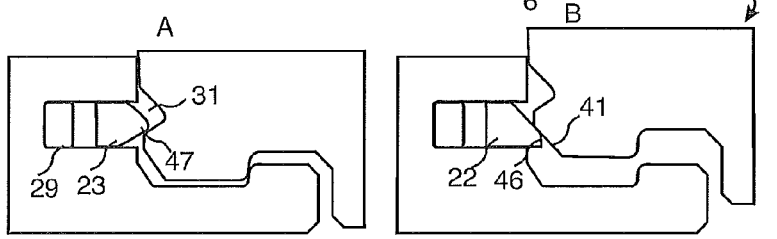
Fig. 6f
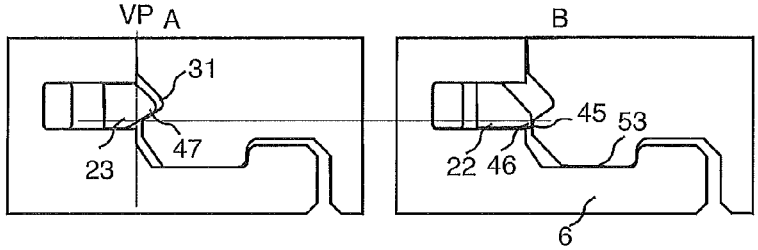

MECHANICAL LOCKING SYSTEM FOR FLOOR PANELS

CROSS REFERENCE TO RELATED APPLICATIONS

The present application claims the benefit of U.S. Provisional Application No. 61/301,402, filed on Feb. 4, 2010. The entire contents of U.S. Provisional Application No. 61/301,402 are hereby incorporated herein by reference.

TECHNICAL FIELD

Embodiments of the invention generally relate to the field of mechanical locking systems for floor panels and building panels especially floor panels with mechanical locking systems, which are possible to lock with a vertical folding.

FIELD OF APPLICATION OF THE INVENTION

Embodiments of the present invention are particularly suitable for use in floating floors, which are formed of floor panels which are joined mechanically with a locking system integrated with the floor panel, i.e. mounted at the factory, that are made up of one or more upper layers of veneer, decorative laminate, solid powder based surfaces, decorative plastic material and similar surfaces, an intermediate core of wood fibre based material or plastic material and preferably a lower balancing layer on the rear side of the core. The following description of known technology, problems of known systems and objects and features of the invention will therefore, as a non restrictive example, be aimed above all at this field of application and in particular at floating flooring formed as rectangular floor panels with long and shorts sides intended to be mechanically joined on both long and short sides. The long and short sides are mainly used to simplify the description of the invention. The panels can be squared and can have more than four sides, which are not parallel or perpendicular to each other.

It should be emphasized that the invention can be applied to any floor panel and it could be combined with all types of known locking system, where the floor panels are intended to be joined using a mechanical locking system connecting the panels in the horizontal and/or vertical directions on at least two adjacent sides. The invention can thus also be applicable to, for instance, solid wooden floors, parquet floors with a core of wood or wood fibre based material and a surface of wood or wood veneer and the like, floors with a printed and preferably also varnished surface, floors with a surface layer of plastic or cork, linoleum, rubber or similar and with core material that do not comprise wood material for example plastic or mineral fibres and similar. Even floors with hard surfaces such as stone, ceramics and similar are included and floorings with soft wear layer, for instance needle felt glued to a board. The invention can also be used for joining building panels which preferably contain a board material for instance wall panels, ceilings, furniture components and similar.

BACKGROUND OF THE INVENTION

Laminate flooring usually comprises a core of 6-12 mm fibreboard; a 0.1-0.8 mm thick upper decorative surface layer of laminate and a 0.1-0.6 mm thick lower balancing layer of laminate, plastic, paper or like material. A laminate surface may comprise a melamine impregnated paper. Recently printed surfaces and wood fibre based paper free laminate surfaces have been developed. The most common core material is fibreboard with high density and good stability usually called HDF—High Density Fibreboard. Sometimes also MDF—Medium Density Fibreboard—is used as core.

Floating laminate and wood floor panels are generally joined mechanically by means of so called mechanical locking systems. These systems comprise locking means, which lock the panels horizontally and vertically. The mechanical locking systems are usually formed by machining the core of the panel. Alternatively, parts of the locking system can be formed of separate materials, which are integrated with the floor panel, i.e. joined with the floor panel in connection with the manufacture thereof.

The main advantages of floating floors with mechanical locking systems are that they are easy to install. They can also easily be taken up again and used once more at a different location. Although many improvements of production cost and function have been accomplished over the years, there is still a need for further improvements.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane (HP) or principal plane" is meant a plane, which extends parallel to the outer part of the surface layer. Immediately juxtaposed upper parts of two adjacent joint edges of two joined floor panels together define a "vertical plane (VP)" perpendicular to the horizontal plane. By "horizontally" is meant parallel to the horizontal plane and by "vertically" parallel to the vertical plane. By "up or upwardly" is meant towards the front side and by "down or downwardly" is meant towards the rear side. By "inwardly" is meant essentially horizontally towards the inner part of the panel and by "outwardly" is meant essentially horizontally and away from the inner part of the panel. By "strip panel" is meant a panel comprising a strip and a locking element. By "groove panel" is meant a panel with a locking groove intended to cooperate with a locking element for horizontal locking.

KNOWN TECHNOLOGY AND PROBLEMS THEREOF

The description of the known technology below is in applicable parts also used in embodiments of the invention.

For mechanical joining of long sides as well as short sides in the vertical and horizontal direction several methods and locking systems could be used. One of the most used methods is the angle-snap method and one of the most used locking systems is a system made in one piece with the core. The long sides are installed and locked by angling. The panel is then displaced, while in the in locked position, along the long side. The short sides are locked by horizontal snapping.

An alternative method is the so-called angling-angling method whereby long and short sides are locked with angling.

Recently a new and simpler method has been developed where all floor panels can be joined with just an angling of the long edges. This installation method generally referred to as vertical folding, is described in FIGS. 1-4.

A new panel 1*c* is locked to a previously installed first panel 1*a* with angling. This angling action connects automatically one short edge of the new panel 1*c* with an adjacent short edge of a second panel 1*b*, which is installed and locked to the first panel 1*a*. The vertical and horizontal locking of the short edges 1*b*, 1*c* takes place with a vertical turning scissors like motion where a flexible tongue 30 is displaced inwardly gradually from one edge to the other edge when a long side of a new panel 1*c* is connected by angling to a long edge of a first panel 1*a* previously installed in an adjacent row. The flexible tongue, which in most cases is made of a plastic section, snaps and locks automatically during folding of the new panel 1*c* when it is angled down to the subfloor. The displaceable tongue is displaced twice, first inwardly into a displacement groove 32 and than outwardly into a tongue grove 31. The flexibility is caused by a horizontal bending of the tongue along the joint. A part of the flexible tongue is during folding pressed to its inner position, as shown in FIG. 2 and other parts are in a completely unlocked position. The flexible tongue snaps into a final locked position when both edges 1*b*, 1*c* are in the same plane as shown by FIG. 3 and locks vertically. A strip 6 with a locking element 8 cooperates with a locking groove 14 and locks the panels horizontally.

The flexible tongue is generally connected to an edge of the strip panel 1*b*. It could also be connected to the groove panel 1*c*. One of the most used tongues on the market is a bristle tongue 30, as shown in FIG. 4, that has an inner part comprising several flexible protrusions 10 and an outer rigid part 30'.

The main problems with know flexible tongues are that the tongue must be made of materials that are rather flexible, that the snapping creates a resistance during folding and that the major part the tongue must be displaced in a groove during locking.

The function of a fold down locking system of the kind described above could be improved if locking could be made without a two-ways snapping action described above and with only limited displacement and material bending. It would be an advantage if the tongue could be connected into a groove in a rather fixed manner.

There are known systems that could be locked with vertical turning combined with twisting as shown in for example WO 2008/004960, FIG. 6 (Välinge Innovation AB). There are several disadvantages related to such locking systems. The tongue is difficult to connect into a groove since the whole tongue must turning vertically during locking. A major part of the tongue is exposed towards an open groove. This makes the whole locking system very sensitive to cutting of the panel across the joint and the tongue could easily be damaged or fall out from the groove. The tongue could also turn during transportation and material handling. A considerable amount of material must be removed in order to form cavities or groove that could house such turn snap systems. This affects the stability of the edge in a negative way.

SUMMARY OF THE INVENTION

A basic objective of embodiments of the present invention is to provide an improved mechanical locking system comprising a tongue that locks automatically during folding without any snapping parts that are displaced inwardly and outwardly during locking.

A first specific objective of embodiments is to create a non-snapping tongue with a simple cross section that could be connected in a horizontally extending fixation groove with limited depth, which surrounds and protects a major part of the tongue.

A second specific objective of embodiments is to create a tongue where the main part of the tongue could be fixed firmly into a groove and were only parts of the tongue are displaced inside and/or outside the fixation groove.

The above objects of embodiments of the invention are achieved wholly or partly by a mechanical locking systems and floor panels, according to the independent claim. Embodiments of the invention are evident from the dependent claims and from the description and drawings.

According to a first aspect of the invention, a set of floor panels are provided which are mechanically connectable to each other along one pair of adjacent edges by a vertical turning motion, so that upper joint edges of said floor panels in the connected state define a vertical plane. Each of said floor panels comprising a tongue on a first edge of a panel having a length direction extending parallel with the first edge and a tongue groove on a second opposite edge of the panel for receiving the tongue of an adjacent panel for mechanically locking together said adjacent edges in a vertical direction. The tongue has an inner part mounted in a sideward open fixation groove in the first edge and an outer part extending beyond the vertical plane. The inner part is fixed in the sideward open fixation groove. The tongue comprises one or several rocker arms extending in the length direction of the tongue. Each rocker arm comprises a displaceable pressing protrusion that during locking is in contact with the second edge and a displaceable locking protrusion that in locked position cooperates with the tongue groove.

Said floor panels may further comprise a locking element formed in one piece with the panel at the first edge and a locking groove at the opposite second edge. The locking groove is open towards a rear side of the panel that faces a subfloor. The locking element and the locking groove form a horizontal mechanical connection perpendicularly to the vertical plane. The tongue preferably comprises resilient parts, formed of a separate material than the core. The panels may be mechanically joined together with vertical folding by displacement of said two panels towards each other with a combined vertical and turning motion. The pressing and the locking protrusion of each rocker arm are preferably positioned at different vertical and horizontal positions.

According to a second aspect of the invention a tongue is provided comprising a main tongue body having an elongated shape and a length direction. The tongue is intended to be connected into a groove formed in a building panel wherein the tongue comprises one or several rocker arms located along its length and extending in the length direction of the tongue and wherein the rocker arms are displaceable such that one part of the rocker arm is displaceable inwardly towards the main tongue body and another part of the rocker arm is displaceable outwardly away from the main tongue body.

The above described locking system and the tongue allows that panels could be locked automatically during vertical folding or vertical displacement without any snapping parts that are active and that create snapping resistance. A strong locking could be obtained with a tongue that has limited flexibility and that is fixed into the fixing groove during production, transport and installation. Only a rather limited horizontal turning of the rocker arms is required to lock the panels vertically.

The embodiments and principles related to vertical locking could also be used to connect building panels with a horizontal displacement.

The tongue is preferably factory connected but it could of course be delivered separately in blanks or as a separate loose component and inserted into a groove during installation.

BRIEF DESCRIPTION OF THE DRAWINGS

FIGS. 6*a-f* illustrate vertical folding with rotating tongue parts.

DESCRIPTION OF EMBODIMENTS OF THE INVENTION

To facilitate understanding, several locking systems in the figures are shown schematically. It should be emphasized that improved or different functions can be achieved using combinations of the preferred embodiments.

Figure 1:
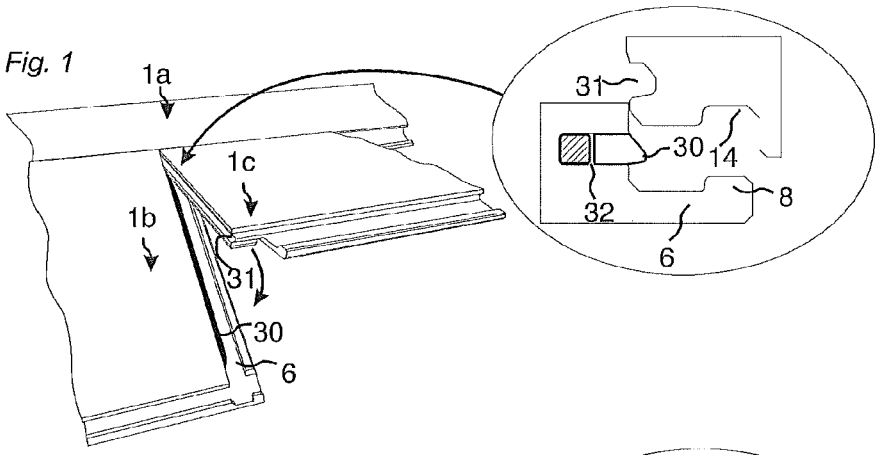
FIGS. 1-4 illustrate known art.
Figure 2:
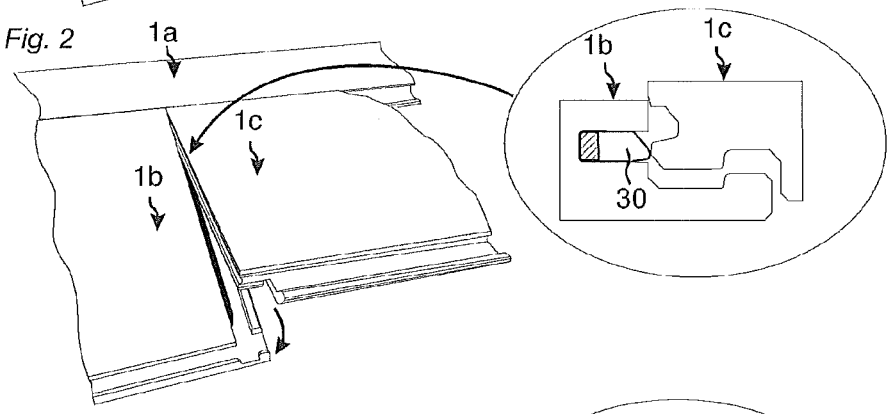
Figure 3:
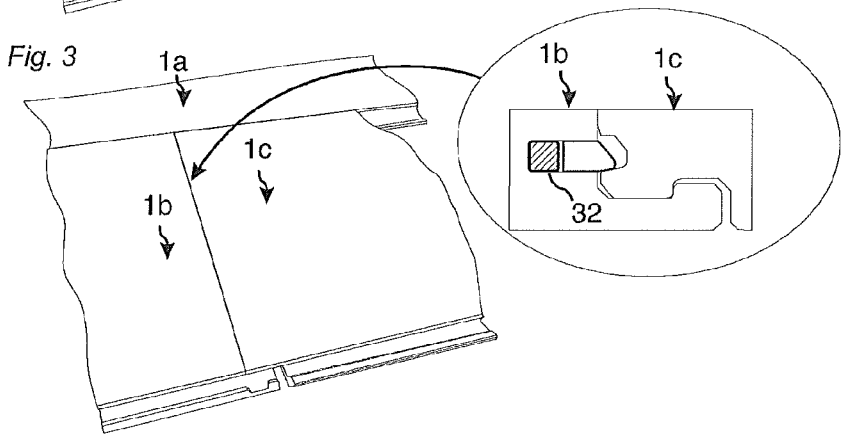
Figure 4:
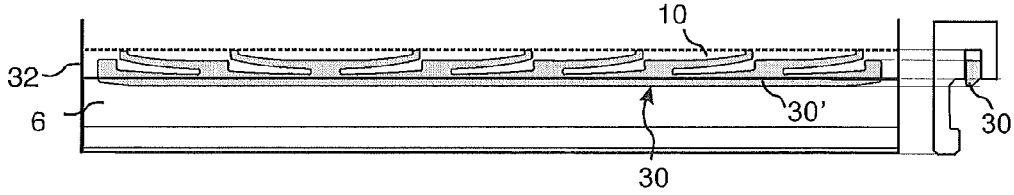
Figure 5A:
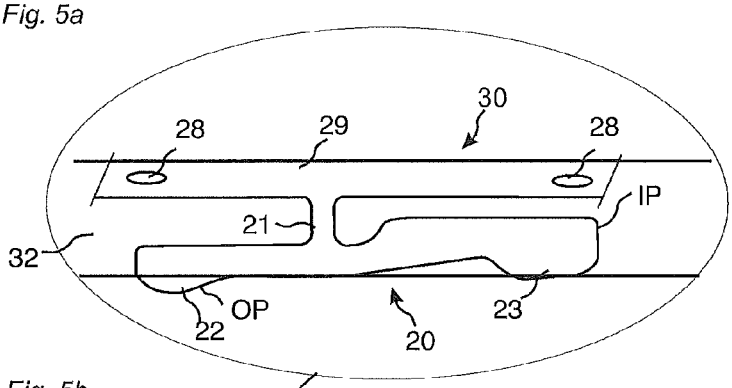
FIGS. 5*a-d* illustrate embodiments of the invention.
Figure 5B:
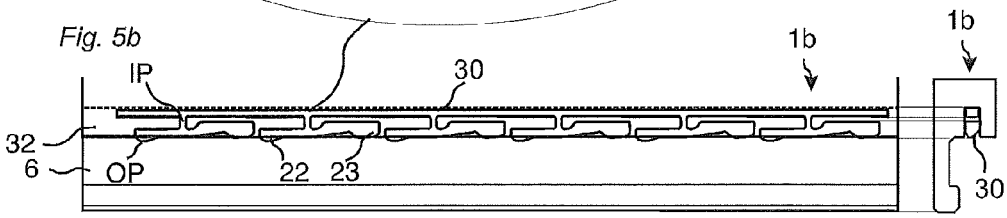

FIGS. 5*a*-5*d* show a tongue 30 according to an embodiment of the invention. FIGS. 5*a* and 5*b* show a tongue 30, which is inserted into a fixation groove 32 of a panel 1*b*, comprises an inner part IP with a main tongue body 29 and a rocker arm 20 which is connected with a fastening device 21 to the main tongue body 29.

Figure 5C:
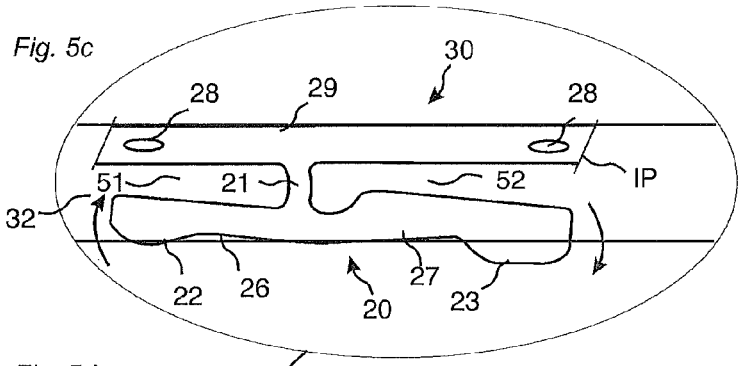

FIG. 5*c* shows that the rocker arm comprises a pressing protrusion 22 located on a pressing arm 26 and a locking protrusion 23 located on a locking arm 27. The rocker arm is designed such that the locking protrusion 23 is displaced outwardly away from the main tongue body 29 when the pressing protrusion 22 is pressed and displaced inwardly towards the main tongue body 29. The rocker arm is preferably designed such that it could turn horizontally about 3-10 degrees during locking. The turning is facilitated by a cavity 51, which is formed between the main tongue body 29 and the pressing arm 26 allowing the pressing arm to be turned and displaced inwardly towards the main tongue body. A cavity 52 is preferably also formed between the locking arm 27 and the main tongue body 29

Figure 5D:
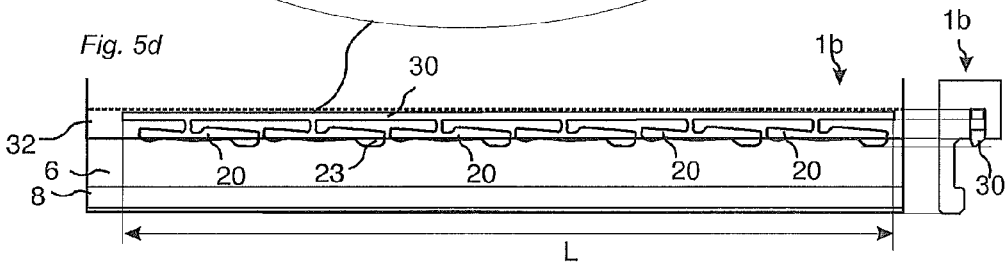

Several rocker arms are preferably located along the length direction L of the tongue as shown in FIGS. 5*b* and 5*d*. The rocker arms could have different shapes and lengths and some could be mirror shaped and oriented in different directions along the tongue. It is preferred that the rocker arms have a length, which exceeds the depth of the fixation groove 32.

The tongue is preferably connected to the fixation groove 32 with friction connections 28. Several tongues could be connected into a groove along the edge but also over and under each other. The friction connections 28 could be designed such that the tongue is connected in a rather loose way or in a rather fixed way with firm friction. Even glue or snapping connections, where the core material is bended or compressed, could be used to fix the tongue into the fixation groove 32. The friction 28 connections could be located on protruding parts that could flex vertically in order to eliminate production tolerances.

FIGS. 6*a-f* show vertical folding and a connection of two adjacent edges 1*b*, 1*c* with a combined vertical and turning motion. The tongue is preferably connected to the strip panel 1*b* comprising a strip 6 with a locking element 8 that cooperates with a locking groove 14 in an adjacent panel edge for horizontal locking of the edges. The tongue could also be connected to the groove panel comprising the locking groove 14 and a tongue groove 31. FIG. 6*d* shows two cross sections A-A and B-B of two adjacent edges 1*b* and 1*c* in an unlocked position. A-A is a cut at the locking protrusion 23 and B-B is a cut at pressing protrusion 22 that is also shown in FIGS. 6*b* and 6*c*. The locking protrusion 23 is in its inner position and the pressing protrusion 22 is in its outer position and protrudes beyond the vertical plane VP. The groove panel 1*c* comprises preferably a lower sliding surface 41, preferably formed as a bevel, that cooperates with a preferably inclined or rounded upper surface 42 of the pressing protrusion 22.

FIG. 6*e* shows that the pressing protrusion 22 is pressed inwardly by a lower part of the grove panel 1*c*, preferably the lower sliding surface 41 and causes a turning motion of the rocker arm 20, as shown in FIGS. 6*b* and 6*c*, such that the locking protrusion 23 is displaced outwardly towards a tongue groove 31 formed in the adjacent edge. The turning is mainly accomplished with a bending of the resilient fastening device 21.

FIG. 6*f* shows cross sections of the edges in the locked position when the locking protrusion 23 is in contact with the tongue groove 31 and locks the edges in a vertical direction parallel to the vertical plane VP. The pressing protrusion 22 is locked horizontally against a locking edge 45 of the groove panel 1*c*. The outer part 46 of the pressing protrusion 22 is preferably located below the outer part 47 of the locking protrusion 23.

The locking could be accomplished essentially with only a turning motion in essentially a horizontal plane. The pressing and locking protrusions are preferably turning in essentially the same plane. Such turning is facilitated if the tongue groove 31 and the locking protrusion 23 preferably have contact surfaces 43, 44 that are inclined in relation to the horizontal plane. Such inclination is preferably 10-50 degrees. It is an advantage if the tongue groove locking surface 44 is more inclined than the locking surface 43 of the locking protrusion 23.

The locking could also be combined with bending of the pressing and locking arms. The locking system could also be designed such that the locking protrusion creates a pressure against the adjacent edge during locking whereby the rocker arm is slightly bended during locking and/or in locked position. This pressure is released partly or completely when the tongue groove 31 is in a position that allows the outer part 47 of the locking protrusion to enter into the tongue groove 31.

It is preferred that the final locking is made with horizontal pre tension between the locking protrusion and the tongue groove. Such pre tension is used to overcome production tolerances and to press the adjacent edges 1*b*, 1*c* vertically towards each other in order to preferably accomplish a tight vertical fit between the strip 6 and the adjacent joint part 53 of the groove panel 1*c*.

The configuration of the rocking arms could be adapted to the contact angles of the adjacent edges during folding. FIG. 6*a* shows that a pressing against a pressing protrusion located close to the long side edge 1*b*' and at a distance from the other pressing protrusions starts at a higher angle than the pressing against a pressing protrusion located close to the opposite free long side edge 1*b*".

Long and short edges are used to simplify the description. The panels could be square.

Figure 7A:
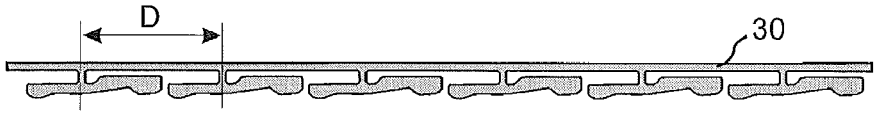
FIGS. 7*a-d* illustrate a tongue blank and a second embodiment with an inclined displacement groove.
Figure 7B:
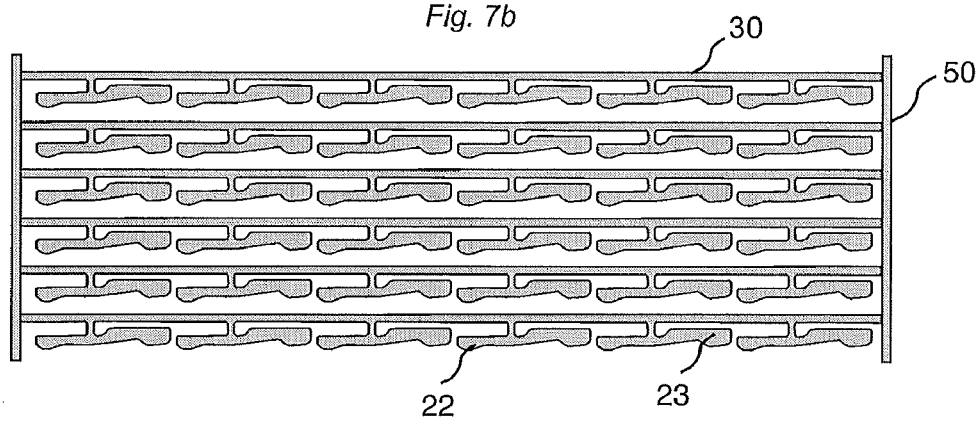

FIGS. 7*a*, 7*b* show a tongue and a tongue blank 50 comprising several tongues. Very advanced tongue shapes could be formed with injection moulded plastic components and each rocker arm could have an individual design. The cross section of a pressing and/or locking protrusion may vary between the rocking arms located along the tongue.

It is an advantage if the rocker arms are compacts and located close to each other such that a lot of locking protrusions are active during locking. In small and thick panels only one rocker arm could be sufficient. In most applications several rocker arms should be used. The distance D between the fastening devices 21 should preferably not exceed four times the floor thickness T. Very compact tongues could be made where the distance D between the fastening devices 21 is only about 2 times the floor thickness. This means that a locking system in a 7-10 mm laminate flooring could comprise several locking protrusion with a distance of about 2 cm and this gives a very strong vertical locking.

The distance between the fastening devices 21 along the tongue is preferably larger than the distance between the pressing and locking protrusions 22, 23.

Figure 7C:
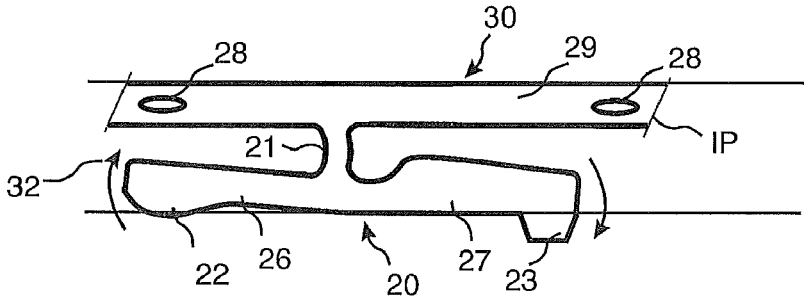

It is an advantage if the locking protrusion 23 is very compact as shown in FIG. 7*c*. The length of the pressing protrusion along the edge is preferably smaller than the floor thickness.

Figure 7D:
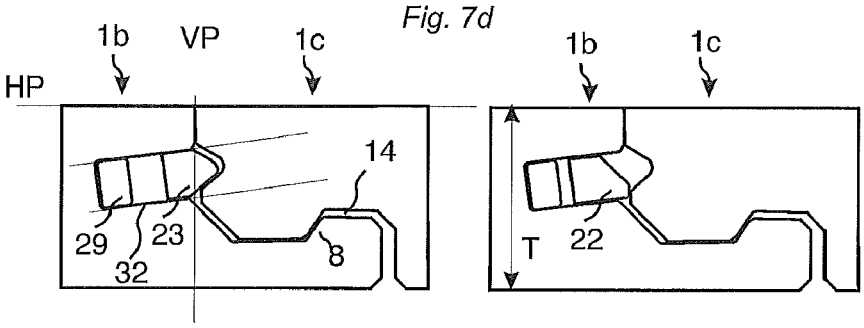

FIG. 7*d* show that it could be an advantage if the fixation groove 32 is inclined against the horizontal plane HP. This facilitates the insertion of the tongue into the fixation groove and the turning of the pressing extension could be made with a lower pressing force. This embodiment comprises a locking element 8 and a locking groove 14 that have inclined cooperating locking surfaces. Such an embodiment could also be locked and unlocked with angling.

The principles described above could be used to provide locking systems that snaps in the same way as the known systems. The pressing and/or locking protrusion could be formed such that they are displaced inwardly and outwardly during locking such that they snap into a tongue groove.

All principles and embodiment described above could be used to lock floor panels horizontally with a horizontal displacement against each other. The tongue is located in a vertically extending fixation groove which could be formed in the groove panel with its opening towards the rear side or on the strip panel with its opening towards the front side. A tongue and groove could be used to lock the panels vertically. The rocker arms will in this embodiment turn or snap in a vertical plane. The fixation groove could be inclined and several rounded or beveled sliding surfaces could be used to facilitate the vertical rotation or snapping of the rocker arms.

All known materials that are described and used in fold down systems of the kind described in FIGS. 1-4 could be used to form tongues according to the invention. The rocker tongues could be adapted to fit into a displacement groove of the known bristle tongues and the same inserting equipment could be used.

The rocker arms could of course be formed with one or two legs and in a way that they could be bended inwardly and outwardly during locking. Such a tongue could be used to connect floor panels with snapping actions where the rocker arms are displace inwardly and are snapping outwardly during locking.

The invention claimed is:

1. A set of floor panels which are mechanically connectable to each other along one pair of adjacent edges by a vertical motion, so that upper joint edges of said floor panels in the connected state define a vertical plane, each of said floor panels comprising:

a tongue on a first edge of a panel having a length direction extending parallel with the first edge;

a tongue groove on a second opposite edge of the panel for receiving the tongue of an adjacent panel for mechanically locking together said adjacent edges in a vertical direction;

wherein the tongue has an inner part mounted in a sideward open fixation groove in the first edge and an outer part extending beyond the vertical plane, the inner part is fixed in the sideward open fixation groove, wherein the tongue comprises at least one rocker arm extending in the length direction of the tongue, the rocker arm comprising a displaceable pressing protrusion that during locking is in contact with the second edge and a displaceable locking protrusion that in locked position cooperates with the tongue groove, wherein the locking protrusion is displaced outwardly away from the main tongue body when the pressing protrusion is pressed and displaced inwardly towards the inner part of the tongue.

2. The set of floor panels as claimed in claim 1, wherein the inner part of the tongue comprises the main tongue body and the rocker arm comprises a fastening device that connects the rocker arm with the main tongue body.

3. The set of floor panels as claimed in claim 2, wherein the fastening device is flexible and located between the pressing protrusion and the locking protrusion.

4. The set of floor panels as claimed in claim 1, wherein the pressing protrusion protrudes from a pressing arm and the locking protrusion protrudes from a locking arm.

5. The set of floor panels as claimed in claim 4, wherein the locking protrusion is locked against the tongue groove with pre tension.

6. The set of floor panels as claimed in claim 1, wherein the tongue groove is formed in a core of the panel and is open towards the vertical plane.

7. The set of floor panels as claimed in claim 1, wherein the floor panels are provided with a horizontal mechanical connection locking the panels horizontally perpendicularly to the vertical plane.

8. The set of floor panels as claimed claim 7, wherein the horizontal mechanical connection comprises a locking element formed in one piece with the panel at the first edge and a locking groove at the opposite second edge, the locking groove being open towards a rear side of the panel that faces a subfloor.

9. The set of floor panels as claimed in claim 1, wherein said first and second opposite edges of the floor panels are mechanically connectable by vertical folding, a combined vertical and turning motion.

10. The set of floor panels as claimed in claim 1, wherein the tongue comprises resilient parts formed of a separate material than the core.

11. The set of floor panels as claimed in claim 10, wherein the resilient parts are formed of an injection moulded plastic material.

12. The set of floor panels as claimed in claim 1, wherein the sideward open fixation groove is open towards the vertical plane.

13. The set of floor panels as claimed in claim 1, wherein the pressing protrusion comprises the outer part of the tongue in an unconnected state and the locking protrusion comprises the outer part in a connected state.

14. The set of floor panels as claimed in claim 1, wherein the at least one rocker arm during locking is turning in a horizontal plane parallel to the panel surface and perpendicular to the vertical plane.

15. The set of floor panels as claimed in claim 1, comprising multiple rocker arms, wherein the rocker arms are spaced from each other in the length direction of the tongue.

16. The set of floor panels as claimed in claim 1, wherein the pressing protrusions and the locking protrusions are spaced from the main tongue body and wherein the tongue comprises cavities formed between the main tongue body and the rocker arm.

17. A tongue comprising a main tongue body having an elongated shape and a length direction and adapted to be connected into a groove formed in a building panel wherein the tongue comprises at least one rocker arm located along its length and extending in the length direction of the tongue and wherein the rocker arm is displaceable such that one part of the rocker arm is displaceable inwardly towards the main tongue body and another part of the rocker arm is displaceable outwardly away from the main tongue body, wherein displacement of the one part of the rocker arm inwardly towards the main tongue body causes the another part of the rocker arm to be displaced outwardly away from the main tongue body.

18. The tongue as claimed in claimed in claim 17, wherein at least a part of the rocker arm is flexible.

19. The tongue as claimed in claim 17, wherein the rocker arm comprises a fastening device that connects the rocker arm to the main tongue body.

20. The tongue as claimed in claim 17, wherein the tongue constitutes a part of a tongue blank, the tongue blank comprising several tongues and wherein the blank is an injection moulded plastic component.

21. A tongue comprising a main tongue body having an elongated shape and a length direction and adapted to be connected into a groove formed in a building panel wherein the tongue comprises at least one rocker arm located along its length and extending in the length direction of the tongue and wherein the rocker arm is displaceable such that one part of the rocker arm is displaceable inwardly towards the main tongue body and another part of the rocker arm is displaceable outwardly away from the main tongue body, wherein the another part of the rocker arm is displaced outwardly away from the main tongue body when the one part of the rocker arm is pressed and displaced inwardly towards the main tongue body; and wherein the rocker arm comprises protrusions protruding outwardly from the main tongue body and spaced from each other in the length direction of the tongue.

22. The tongue as claimed in claim 21, wherein one of the protrusions is displaced outwardly away from the main tongue body when the other protrusion is pressed and displaced inwardly towards the main tongue body.

23. The tongue as claimed in claim 21, wherein the protrusions are spaced from the main tongue body and wherein the tongue comprises cavities formed between the main tongue body and the rocker arm.

24. The tongue as claimed in claim 21, comprising multiple rocker arms, wherein the protrusions located on one of the rocker arms are spaced in the length direction from the protrusions located on another one of the rocker arms.

* * * * *